United States Patent [19]

Hasman

[11] 4,158,665

[45] Jun. 19, 1979

[54] HYDROGENATION OF GLYCERIDE OILS

[75] Inventor: John M. Hasman, Chatham, N.J.

[73] Assignee: SCM Corporation, New York, N.Y.

[21] Appl. No.: 850,150

[22] Filed: Nov. 10, 1977

Related U.S. Application Data

[63] Continuation-in-part of Ser. No. 733,348, Oct. 18, 1976, abandoned.

[51] Int. Cl.[2] ..... C11C 3/12

[52] U.S. Cl. ..... 260/409

[58] Field of Search ..... 260/409

[56] References Cited

U.S. PATENT DOCUMENTS 2,357,352 9/1944 Paterson ..... 260/409

3,856,710 12/1974 Moulton et al. ..... 260/409 X

OTHER PUBLICATIONS

Popescu, "High Oleic Oils by Selective Hydrogenation of Soybean Oil", JAOCS 46; 97–99 (1969).

*Primary Examiner*—John Niebling

*Attorney, Agent, or Firm*—Jerry K. Mueller, Jr.

[57] ABSTRACT

Glyceride oil contaminated with soap is hydrogenated in rapid fashion in the presence of nickel hydrogenation catalyst and of copper chromite adjunct catalyst, wherein the proportion of adjunct catalyst is adjusted broadly proportional to the soap concentration so that the hydrogenation proceeds substantially insensitively to said contaminant soap.

13 Claims, 3 Drawing Figures

HYDROGENATION OF GLYCERIDE OILS

CROSS-REFERENCE TO RELATED APPLICATIONS

This application is a continuation-in-part of application U.S. Ser. No. 733,348, filed on Oct. 18, 1976, now abandoned.

BACKGROUND OF THE INVENTION

This invention relates to a process for catalytically hydrogenating triglyceride oil and more particularly to hydrogenating in extremely rapid fashion oil containing contaminant soap.

Heretofore it has been proposed to catalytically hydrogenate oil in the presence of nickel catalyst, copper-chromite catalyst (optionally metal oxide stabilized), or a combination of these two catalysts. Typically, the oil is touched-up to prevent rancidity or is made to a shortening consistency-like product (IV suitably about 60–65) when the combination of the two catalysts is used. The feed oil has been refined to remove contaminant soap and free fatty acid which tend to poison the catalysts and to render them ineffective in the hydrogenation process.

The present invention now makes it possible to catalytically hydrogenate oil in the presence of relatively high proportions of contaminant soap and of free fatty acid. The hydrogenation process proceeds very rapidly when producing a hydrogenated oil product having an Iodine Value of 60–100 and astonishingly rapid when producing a product stearine having an Iodine Value of less than about 30. The hydrogenation process is maintained by adjusting the proportion of adjunct catalyst proportional to the concentration of soap and free fatty acid contaminants in the feed oil.

SUMMARY OF THE INVENTION

Glyceride oil contaminated with soap is catalytically hydrogenated with hydrogen gas in a hydrogenation zone under glyceride oil hydrogenation conditions to produce a hydrogenated oil product having an Iodine Value (IV) at least as low as about 100, advantageously about 60–70, and preferably not substantially above about 30. The hydrogenation process proceeds substantially insensitively to the presence of said contaminants in the presence of nickel hydrogenating catalyst and of copper-chromite adjunct catalyst. The concentration of the adjunct catalyst is adjusted broadly proportional to the contaminant concentration in the feed oil fed to the zone.

DETAILED DESCRIPTION OF THE INVENTION

Figure 1:
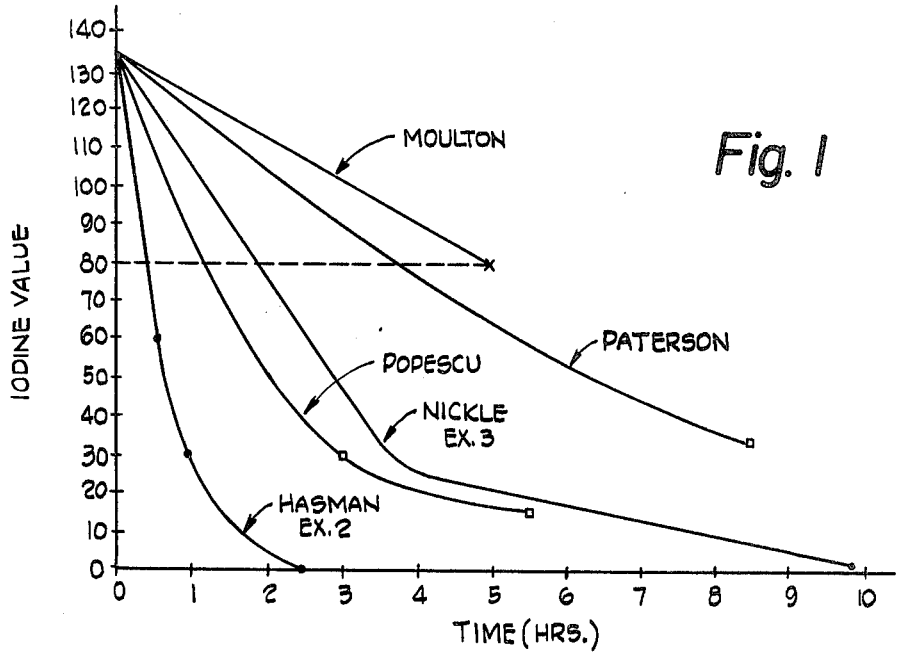
FIG. 1 is a scaled graph indicating the IV in a series of comparative hydrogenation runs as a function of hydrogenation time.

The feed oil can contain from about 0.01 to about 0.25 weight-percent or higher of contaminant soap. Hydrogenation as conventionally practiced requires the soap content in the oil to be about 0.001 to about 0.003 weight-percent or less. Commercial refineries generally can produce oil of this quality, though refining costs can increase when a more pure oil is required. The present invention permits use of a cruder grade of feed oil for hydrogenation and, thus, can reduce refining costs.

Generally, the adjunct catalyst is present in the zone in an amount of at least about 0.25 weight-percent based on the weight of the oil in the zone for maintaining speed and efficiency of the process. The adjunct catalyst can be present up to about 3 weight-percent or higher depending upon the concentration of soap contaminant in the feed oil.

The nickel catalyst is present in the zone in an amount of greater than 0.02 weight-percent and this amount can range from about 0.025 to 0.3 weight percent or higher. At these higher levels of nickel catalyst, the present process proceeds very rapidly regardless of the type of hydrogenated product being made. Consequently, the present hydrogenation process can produce a stearine product (IV not substantially above about 30) in astonishingly rapid fashion. Generally, hydrogenation times of only about one hour are required to achieve a 30 IV and between one and four hours to achieve a 0–5 IV of the hydrogenated product.

The present process also permits production of less hydrogenated products having IV of not substantially above about 100 and typically in the range of 60–100 IV with a 60–70 IV preferred, when a shortening-like consistency is desired. Short times of hydrogenation are experienced here also substantially independent of the concentration of contaminant soap in the feed oil. The fatty acid in the oil also tends to suppress hydrogenation as free fatty acid is refractory towards hydrogenation. The present process also proceeds substantially insensitively to the presence of free fatty acid.

The nickel hydrogenation catalyst can be in supported or unsupported form. Typical support materials include alumina, silica gel, activated carbon and the like. The nickel catalyst can be made by thermally decomposing nickel formate or other heat-labile nickel salt in fatty oil at about 425°–450° F. or by precipitating a nickel salt on an inert carrier followed by reduction with hydrogen gas. The nickel catalyst also can be prepared by the treatment of electrolytically precipitated nickel hydroxide which may be prepared by passing direct current through a cell using nickel as the anode and using a dilute solution of an alkali salt of a weak acid as an electrolyte. The nickel hydroxide so prepared may be conventionally reduced, such as, in the presence of hydrogen gas. The particular manner of preparing the nickel hydrogenating catalyst is not critical to the present invention as the present invention employs those nickel hydrogenation catalysts well known and used in the art today. For present purposes by nickel catalyst is meant the nickel metal content of such catalyst.

The copper chromite adjunct catalyst can be provided in supported or unsupported form. The copper chromite adjunct catalyst can be stabilized with an alkaline earth metal oxide, such as barium oxide or calcium oxide, or with a multivalent metal oxide, such as manganese oxide, although this is not essential. Typically, the oxide stabilizing material ranges from about 4% to 8% by weight of the adjunct catalyst. The molar ratio of the copper to chromite components in the adjunct catalyst is not critical and such components can be in typical amounts as heretofore conventionally used in the hydrogenation art. Typically, the molar ratio of such components is about 1:1. While the nickel catalyst and the adjunct catalyst can be simultaneously deposited on an inert carrier or provided separately in supported form in admixture, it is only essential in the present invention that the catalyst and adjunct catalyst both be present in the primary hydrogenation zone during the hydrogenation reaction.

Though the catalyst-adjunct catalyst is a synergistic combination in the hydrogenation process, it is believed that certain dominant effects can be attributed to each individually in the present process.

The copper-chromite adjunct catalyst appears to act as a soap contaminant suppressant so that its concentration in the hydrogenation zone can be correlated and adjusted broadly proportional to the concentration of soap contaminant (and to a degree the phosphatides and free fatty acid) in the feed oil. The concentration of the adjunct catalyst, however, should be present in an amount of at least about 0.25 weight-percent based on the weight of the oil in the primary hydrogenation zone for maintaining the overall speed and efficiency of the hydrogenation process. Generally up to as high as about 3 weight-percent adjunct catalyst can be used for the process. Though higher proportions are permissible, higher costs must be reckoned with.

The nickel catalyst, then, appears to act as the prime catalytic agent assisting in the hydrogen absorption by the oil. For overall speed and efficiency of the process, the nickel catalyst should be present at a weight proportion of greater than 0.02 weight-percent and this proportion generally can range from about 0.025 to about 0.3 weight-percent or higher.

Typical sources of the oil are vegetable oil (including nut), animal fat, fish oil and the like. Vegetable oils include the oils of coconut, corn, cottonseed, linseed, olive, palm, palm kernel, peanut, safflower, soybean, sunflower, and like vegetable oils. The oils are refined to remove a variety of impurities therefrom such as free fatty acids, phosphatides, unsaponifiables typically labeled as mucilaginous material, and the like. For purposes of this invention an oil is a full ester of glycerol and fatty acid (triglyceride) which fatty acid has some unsaturation. Preferably the oil is edible.

Alkali-refined oil is prime feedstock for this purpose. Alkali refining of oils is outlined in the following texts: *Kirk-Othmer Encyclopedia of Chemical Technology,* 2nd Edition, Volume 8, pages 798–811 (Interscience Publishers, New York, New York, 1965); and *Bailey's Industrial Oil and Fatty Products,* 3rd Edition, pages 719–896 (Interscience Publishers, New York, New York 1964). These same texts in the passages cited also describe the hydrogenation of oils. These passages are expressly incorporated herein by reference.

Alkali refined oil is a prime feedstock for this process, although it is understood that the oil advantageously can be steam-refined, de-acidified by high vacuum distillation techniques or otherwise refined. Basically, alkali refining comprehends the treatment of the oil with strong (typically 10°–20° Baume) caustic soda to remove the foregoing impurities. Usually excess caustic solution (to neutralize all free fatty acids present) is mixed with the oil at about 70°–90° F. This causes an emulsion to form. Such emulsion then is heated at about 135°–145° F. for breaking it, and the resulting alkali refined oil is recovered by conventional techniques such as filtering, decanting, centrifuging, and the like. By-products formed from the breaking of the emulsion typically include alkali metal soaps of free fatty acids, gums, slimes, and phosphatides. Usually these are sent to a separate recovery treatment, e.g. springing fatty acids from the soaps. At commercial scale operations the alkali refined oil will typically have an impurity content of soaps of about 30 parts per million and of phosphatide of about 90 parts per million based on the oil. For present purposes, the instant process operates efficiently and economically on all typical alkali refined oils regardless of the particular alkali refining process employed.

The instant hydrogenation reduces the number of ethylenic linkages in the fatty acid chains to obtain even comparative low I.V. materials, and can be used to get practical saturation of such linkages. As practiced commercially, the hydrogenation of oils is a liquid phase process in which gaseous hydrogen is dispersed in the heated oil under the influence of a solid catalyst. Though continuous hydrogenation methods have been practiced, most present day commercial hydrogenation operations employ a batch process with particulate hydrogenation catalyst, which catalyst generally is separated from the product hydrogenated oil.

Hydrogenation operations for the instant invention comprise charging the alkali refined oil into a hydrogenation reactor having a hydrogenation zone therein. Hydrogenation conditions for contacting hydrogen gas with the oil typically include temperatures of about 250° to about 500° F. and pressures of about 0 to about 100 psig. Conventionally, a period of 1–2 hours is used when a shortening stock (I.V. suitably of about 60–90) is being made, and this drags out to about 5–11 hours when a stearine (I.V. of less than 30) is being made. Typical hydrogenation reactors include the hydrogen recirculation type which consists of a cylindrical vessel provided with a hydrogen distributor at the bottom through which an excess quantity of hydrogen gas is blown through the oil in the hydrogenation zone. Another typical hydrogenation reaction is the dead-end system which employs a cylindrical pressure vessel with a mechanical agitator of the gas-dispersion type which is supplied from high pressure hydrogen gas storage tanks at the rate and in the volume actually used and leaked. A variety of other hydrogenation reactors are commercially employed and likewise benefically hydrogenate the oil.

In the present process the total reaction is terminated when the Iodine Value of the product is determined to be within specifications for the particular product being made. The Iodine Value of the zone contents can be determined routinely by monitoring an indicia correlative to the Iodine Value of the contents, such as refractive index measurements, ultraviolet or infrared absorption techniques, and the like.

The present hydrogenation process can be performed quite advantageously on a continuous basis. Generally, the catalysts are separated from each other and the intermediate hydrogenated product from both catalysts by a variety of schemes. Typical schemes include holding one catalyst as a fixed bed in the hydrogenation zone while allowing the other catalyst to be freely dispersed in the oil, or providing one catalyst in supported form and the other catalyst in unsupported form for easy screening separation.

The standard and preferred method for determining the concentration of soap in a glyceride oil is the American Oil Chemists Society test method AOCS CC 15–60. Another method that gives essentially the same results, and the one that was used in connection with the following examples, is outlined below. This method is a modified version of the procedure reported by Wolff at Chem. Abstracts, 42, 6243 (1948).

A solvent body is prepared from 50% by weight ethanol, 35% by weight dioxane and 15% by weight water to which is added bromophenol blue (25 mg color indicator per 1 liter solvent body). The color of the solvent body then is adjusted to yellow by the addition of 0.1N hydrochloric acid. A weighed sample of soap-contaminated oil, 5 to 50 grams, is added to 100 ml of the color-adjusted solvent body, and the agitated oil/-solvent body mixture warmed at atmospheric pressure to a temperature sufficient to assist dissolving the oil therein. A larger oil sample is used when a lower soap concentration is expected, and a smaller sample is used when a higher soap concentration is expected. The presence of soap will cause the oil/solvent body to turn green. The agitated, heated oil/solvent body solution then is titrated with 0.02N or 0.01N hydrochloric acid until a yellow color reappears. The more concentrated acid is used for samples expected to contain a higher soap concentration, and the less concentrated acid is used when smaller soap concentrations are expected.

For oils predominating in $C_{18}$ fatty acid equivalent content, such as soybean oil, and when the soap is a sodium salt of fatty acid due to a sodium base (alkali) refining operation of the oil, the concentration of soap in the oil conventionally is calculated as follows (the constant 304,000 treating the soap as though it were totally sodium oleate):

$$\text{ppm soap (as sodium oleate)} = \frac{(304{,}000)\,(\text{normality of HCl})\,(\text{ml of HCl titrated})}{\text{weight of oil sample in grams.}}$$

The constant in the foregoing formula, of course, would be different for oils predominating in fatty acid content of different chain lengths (e.g. palm kernel oil which predominates in $C_{12}$ fatty acids) and for oils refined with other alkalis (e.g. a potassium or ammonium base).

The following examples show in detail how the present invention can be practiced, but they should not be construed as limiting the scope of the present invention. In this specification all percentages and proportions are by weight, all temperatures in degrees Centigrade, and all mesh sizes in United States Standard Sieves Series, unless otherwise expressly indicated.

EXAMPLE 1

The feed oil used was from a lot of commercially alkali refined soybean oil. The analysis of the soybean oil appears below:

| Fatty Acid Content (chain length: no. of double bonds) | weight Percent |
|---|---|
| C14:0 | 0.1 |
| C16:0 | 11.1 |
| C16:1 | 0.1 |
| C17:0 | 0.1 |

-continued

| Fatty Acid Content (chain length: no. of double bonds) | weight Percent |
|---|---|
| C18:0 | 4.0 |
| C18:1 | 22.6 |
| C18:2 | 54.0 |
| C18:3 | 7.8 |
| C20:0 | 0.2 |
| Calculated I.V. of 133.4 | |

The hydrogenation reactions here and in all the Examples were conducted in a two liter pressure vessel equipped with a variable speed stirred agitator and electrical heaters. The vessel was completely evacuated of air, the feed oil charged to the vessel, and heated to 100° C. prior to the reaction. All Iodine Values are measured by refractive index techniques and chemically (Wijs method).

A batch of the soybean oil was hydrogenated according to the precepts of this invention. The oil was severely contaminated with soap and other impurities given below:

| | |
|---|---|
| Soap | 0.21 weight percent |
| Phosphatides | 2803 ppm |
| Iron | 0.57 ppm |
| Color (Lovibond) | 3.5R-35Y |

The hydrogenation conditions were as follows:

| | |
|---|---|
| Feed | 1300 grams of soybean oil |
| Temperature | 220° C. |
| Pressure | 60 psi |
| Agitation | 700 r.p.m. |
| Catalyst | 3% Copper-chromite stabilized with 7.2% barium oxide 0.075% nickel |

After about 7 hours of hydrogenation time the Iodine Value of the oil was determined to be about 60. These results show that rapid hydrogenation of an extremely soap contaminated oil can be performed according to the present invention. Heretofore, hydrogenation processes were restricted to feed oils having about 0.001 weight percent soap. It should be noted further that phosphatides are restricted to about 90–100 ppm in the oil because they tend to suppress the selectivity and speed of hydrogenation by reacting with the nickel catalyst. The present invention can tolerate massive amounts of both soap and phosphatides and still permit rapid, efficient hydrogenation of the oil.

EXAMPLE 2

Another batch of alkali refined soybean oil from a commercial refinery was hydrogenated according to the present invention in order to make a stearine product. The feed oil analysis is given below:

| | |
|---|---|
| Soap | 0.11 weight percent |
| Phosphatides | 4.0 ppm |
| Iron | 0.25 ppm |
| Free Fatty Acid | 0.06 weight percent |
| Color (Lovibond) | 4.9R-50Y |

| Fatty Acid Analysis | Fatty Acids (Wt %) |
|---|---|
| C14:0 | 0.1 |
| C15:0 | trace |
| iso C16:0 | trace |
| C16:0 | 11.1 |
| C16:1 | 0.2 |
| C17:0 | 0.2 |
| iso C18:0 | trace |
| C18:0 | 3.8 |
| C18:1 | 21.4 |
| C18:2 | 53.9 |
| C18:3 | 8.7 |
| C20:0 | 0.4 |
| C22:0 | 0.2 |
| Calculated I.V. 134.7 | |

A series of six 1300 gram lots of the soybean oil was hydrogenated under the following hydrogenation conditions:

| | |
|---|---|
| Temperature | 220–255° C. |
| Pressure | 60 p.s.i. |
| Agitation | 700 r.p.m. |
| Catalyst | 0.025 weight percent nickel<br>1.0 weight percent Copper-Chromite |

Samples of the oil were periodically withdrawn and analyzed in order to determine the time of reaction required to reach an I.V. of about 50–70, of about 30, and about 0. The following results were obtained.

| | SAMPLE 1 | | SAMPLE 2 | | SAMPLE 3 | |
|---|---|---|---|---|---|---|
| RUN No. | Time (Min) | I.V. | Time (Min) | I.V. | Time (Hr) | I.V. |
| 1 | 30 | 70 | 53 | 30 | 2 | 0–1.9 |
| 2 | 35 | 69.7 | 59 | 30 | 2.58 | .4–1.5 |
| 3 | 30 | 68.8 | 60 | 30 | 3 | 0–0.7 |
| 4 | 30 | 53.6 | 55 | 30 | 2.5 | 1.7–2.1 |
| 5 | 60 | 58.7 | 75 | 30 | 3.5 | 1.4–1.5 |
| 6 | 30 | 30 | 30 | 30 | 0.75 | 0 |

The tabled results clearly demonstrate the reproductibility of the present invention for hydrogenating oils and that a stearine product can be made rapidly even from relatively high soap containing oil. The copper chromite adjunct catalyst in runs 1 and 3–6 were barium oxide stabilized while the adjunct catalyst in run 2 was not stabilized.

EXAMPLE 3

Additional batches of the oil of Example 2 were hydrogenated with only nickel catalyst and only with copper chromite adjunct catalyst. Hydrogenation conditions were substantially the same as in the runs of Example 2. The following results were obtained.

| Copper-Chromite - 1.0 Weight-Percent | | |
|---|---|---|
| Run No. | Time (hours) | Iodine Value |
| 1 | 7.75 | 132.3 |
| 2 | 7.25 | 106.5 |
| 3 | 14.75 | 100 |
| 4 | 10.0 | 90–100 |
| 5 | 7.5 | 104.9 |

The adjunct catalyst in runs 2–5 were barium oxide stabilized while the adjunct catalyst in run 1 was not stabilized.

| Nickel - 0.10 Weight Percent | | | | |
|---|---|---|---|---|
| | SAMPLE 1 | | SAMPLE 2 | |
| Run No. | Time (Hrs) | I.V. | Time (Hrs) | I.V. |
| 1 | 5.5 | 30 | 13.0 | 2.8 |
| 2 | 4.5 | 30 | 12.5 | 1.7 |
| 3 | 3.0 | 30 | 7.0 | 0 |
| 4 | 2.0 | 30 | 7.0 | 1.2 |

The above-tabled results show the superiority of using the combination of nickel catalyst and copper-chromite adjunct catalyst for hydrogenating oils. Noteworthy, is the fact that the oil cannot be hydrogenated below about 100 I.V. with the copper chromite adjunct catalyst. Even at the relatively high level of 1.0 weight percent adjunct catalyst, the soap suppressed the reaction. The nickel catalyst runs show extremely protracted hydrogenation times to make a stearine product. The present hydrogenation process can produce a stearine in a few hours or less and proceeds to such results in the presence of contaminant soap. Further tests revealed that comparable times of hydrogenation to get a stearine can be attained only with pure oil (0.001–0.003% soap or less) using about 0.1 weight percent nickel catalyst in order to duplicate the results of the present invention using relatively high-soap contaminated oil.

EXAMPLE 4

Additional lots of the soybean oil described in Example 2 were hydrogenated according to the disclosures of the following prior art citations:

(a) Paterson, U.S. patent no. 2,357,352;

(b) Moulton, U.S. patent no. 3,856,710, and (c) Popescu, *High Oleic Oils by Selective Hydrogenation of Soybean Oil,* JAOCS 46:97–99 (1969).

The results of such runs and the results of Examples 2 and 3 are given below:

| Run | Nickel (wt-%) | Copper Chromite (wt-%) | Time To 30 IV (hr) | Total Time (hr) | Final IV |
|---|---|---|---|---|---|
| Paterson | 0.0025 | 0.2 | — | 8.5 | 33.5 |
| Moulton | 0.0005 | 1.0 | — | 5.0 | 79.6 |
| Popescu | 0.020 | 1.0 | 3.0 | 5.5 | 14.7 |
| Hasman | 0.025 | 1.0 | 0.92 | 2.39 | 0–2.1 |
| Nickel | 0.10 | — | 3.75 | 9.88 | 0–2.8 |

The fourth run, Hasman, is the average of the six runs reported in Example 2. The fifth run, Nickel, is the average of the results reported in Example 3.

Figure 2:
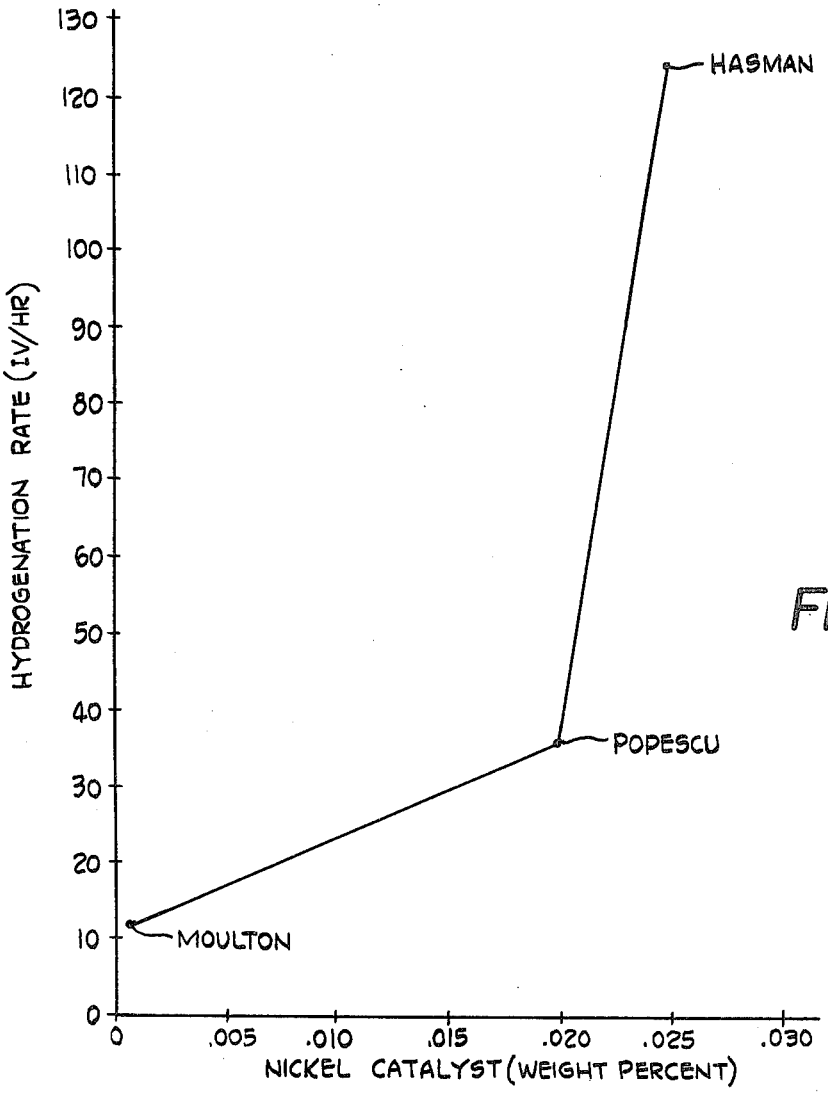
FIG. 2 is a scaled graph indicating the hydrogenation rates of three of the runs reported in FIG. 1 as a function of the nickel catalyst concentration.

FIG. 1 displays graphically the results reported above. Initially, it can be seen readily that applicant's process is the only one which permits reduction of the IV of the oil to reach about a 0 value (feed oil contaminated with 0.1% soap). Of more importance, though, is the rate of hydrogenation (change in IV per unit time) for each process. FIG. 2 displays the rate of hydrogenation as a function of nickel content of the catalyst system at a constant level of 1.0% copper-chromite adjunct catalyst (note, that the Paterson citation results are omitted as the copper-chromite value is other than 1.0%, i.e. it is 0.2%). The rates are calculated based on final IV of the hydrogenated product of 79.6 (the final actual value that all processes could reach). The data for FIG. 2 appears below:

| Run | Nickel (wt-%) | Copper-Chromite (wt-%) | Hydrogenation Rate (IV/hours) |
|---|---|---|---|
| Moulton | 0.0005 | 1.0 | 11.28 |
| Popescu | 0.020 | 1.0 | 35.33 |
| Hasman | 0.025 | 1.0 | 123.67 |

The foregoing rates were calculated by dividing the total change in Iodine Value from the feed oil of 135 (actual value of 134.7 calculated IV and 136.2 chemical IV) to a final value of 79.6 IV (which represents the lowest IV which can be reached by all three processes as reported in FIG. 1) by the total time (in hours) which it took to reach the final IV of 79.6. The rates, then, are average hydrogenation rates for a constant copper-chromite value with only the level of nickel being adjusted for a feed oil containing 0.1 weight-percent contaminant soap.

While increasing the level of nickel does moderately speed up the reaction, it is totally unexpected that the rate would so dramatically increase at a nickel value of greater than 0.02%.

EXAMPLE 5

In order to demonstrate the depressant effect which soap has on hydrogenation processes in general and the present invention's alulity to suppress such effect, additional hydrogenation runs were conducted on soybean oil which had been reprocessed to substantially eliminate the presence of soap. That said reprocessed soybean oil analyzed as follows:

| Feed Soybean Oil | |
|---|---|
| moisture | 0.0% |
| Soap | 0.003% |
| iron | 0.25 ppm |
| phosphatides | 2.0 ppm |
| free fatty acid | 0.07% |
| Chemical IV | 136.2 |
| color | 4.1R-50Y |

| Fatty Acid No. | Fatty Acid Content (weight-percent) |
|---|---|
| C14:0 | 0.1 |
| C15:0 | — |
| C16:0 | 11.1 |
| C16:1 | 0.1 |
| C17:0 | — |
| iso C18:0 | trace |
| C18:0 | 3.8 |
| C18:1 | 21.4 |
| C18:2 | 54.3 |
| C18:3 | 8.8 |
| C20:0 | 0.3 |
| C22:0 | 0.1 |

The following hydrogenation run conditions were employed:

| | |
|---|---|
| Feed | 1300 grams |
| Temperature | 210–225° C. |
| Pressure | 60 p.s.i. (hydrogen) |
| Agitation | 600/700 r.p.m. |

The results of hydrogenation runs are reported below:

| | Ni (wt-%) | Copper Chromite (wt-%) | Time to 30IV (hr) | Total Time (hr) | Final IV |
|---|---|---|---|---|---|
| | | Reprocessed Oil | | | |
| Nickel No. 1 | 0.10 % | — | 0.5 | 1.21 | 0 |
| Hasman No. 1 | 0.025% | 1.0% | 0.5 | 0.75 | 0 |
| | | *Soapy Oil (0.1% soap) | | | |
| Nickel No. 2 | 0.10 % | — | 3.75 | 9.88 | 0–2.8 |
| Hasman No. 2 | 0.025% | 1.0% | 0.92 | 2.39 | 0–2.1 |

*Nickel No. 2 - Average of 4 runs of Example 3.
Hasman No. - Average of 6 runs of Example 2.

Figure 3:
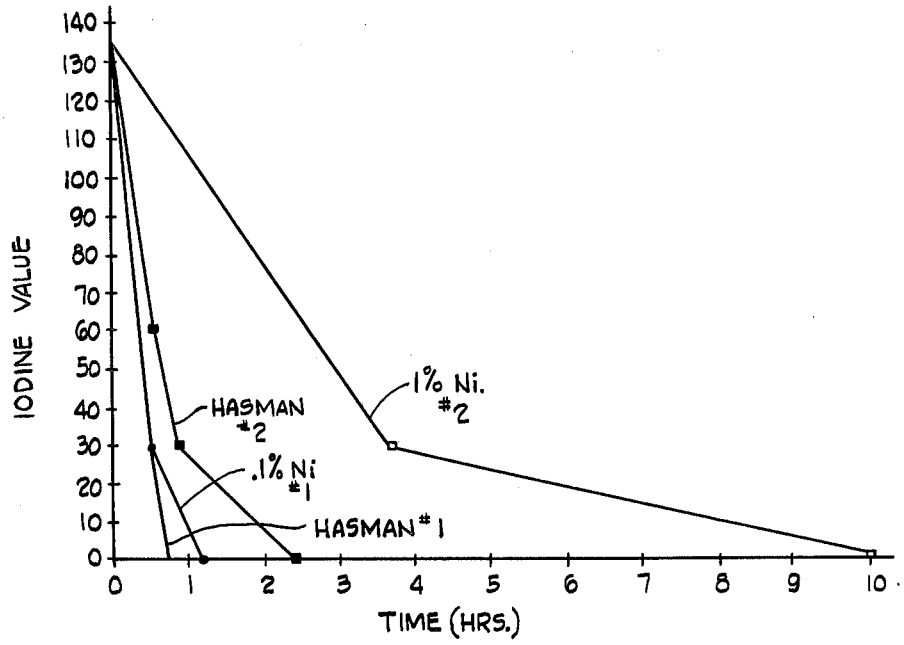
FIG. 3 is a scaled graph for showing the soap depressant effect on hydro-genation processes using only nickel hydrogenation catalyst compared to use of the present invention by plotting the Iodine Value as a function of the hydrogenation time.

The results of the foregoing runs are displayed in FIG. 3.

The foregoing results demonstrate that hydrogenation of substantially pure oils can be performed with substantially only nickel catalyst and that the copper chromite adjunct catalyst has minimal beneficial contribution to the process, but that as the concentration of contaminant soap in the feed oil increases to within the range of about 0.01 to about 0.25 weight-percent, the copper chormite adjunct catalyst in combination with the nickel hydrogenation catalyst does substantially suppress the depressant effect which the contaminant soap has on the hydrogenation process by adjustment of the level of copper chromite adjunct catalyst broadly proportional to the concentration of soap in the feed oil.

I claim:

1. A process for the hydrogenation of a glyceride oil contaminated with soap wherein the resulting hydrogenated product has an Iodine Value (IV) at least as low as about 100, comprising:

subjecting said oil to hydrogenation in a hydrogenation zone with hydrogen gas under hydrogenation conditions in the presence of greater than 0.02 weight-percent nickel hydrogenation catalyst and of greater than about 0.25 weight-percent copper-chromite adjunct catalyst, both weight-percentages based on the weight of the oil in said zone; and establishing and maintaining the concentration of said adjunct catalyst in said zone broadly proportional to the soap concentration in said feed oil fed to said zone, said soap concentration being from about 0.01 to about 0.25 weight-percent by weight of said feed oil, said hydrogenation proceeding substantially insensitively to the presence of said contaminant soap in said feed oil.

2. The process of claim 1 wherein said nickel hydrogenation catalyst is present from about 0.025 to about 0.3 weight-percent and said adjunct catalyst is present from about 0.25 to about 3 weight-percent.

3. The process of claim 2 wherein said adjunct catalyst is present from about 1 to about 3 weight-percent.

4. The process of claim 1 wherein said resulting hydrogenated product has an Iodine Value (IV) of between about 60 and about 100.

5. The process of claim 4 wherein said resulting hydrogenated product has an Iodine Value (IV) of between about 60 and about 70.

6. The process of claim 1 wherein the resulting hydrogenated product has an Iodine Value (IV) of not substantially above about 30.

7. The process of claim 1 wherein said adjunct catalyst is stabilized with a metal oxide.

8. The process of claim 7 wherein said metal oxide is barium oxide.

9. The process of claim 7 wherein said metal oxide is manganese oxide.

10. The process of claim 1 wherein said feed oil is admitted continuously into an inlet of said hydrogenation zone and the resulting hydrogenated product is withdrawn continuously from an outlet of said hydrogenation zone.

11. The process of claim 10 wherein an indicia correlative to the Iodine Value (IV) of the oil near said outlet is monitored continuously during said hydrogenation, and at least one adjustable hydrogenation condition of said zone is adjusted in response to variation of said indicia and to a degree adequate for maintaining said indicia, thus the corresponding Iodine Value (IV) of the product, substantially constant.

12. A process for the hydrogenation of a glyceride oil contaminated with soap wherein the resulting hydrogenated product is a stearine having an Iodine Value (IV) not substantially above about 30, comprising:

subjecting said oil to hydrogenation in a hydrogenation zone with hydrogen gas under hydrogenation conditions in the presence of between about 0.025 and about 0.3 weight-percent nickel hydrogenation catalyst and of between about 0.25 and about 3 weight-percent copper-chromite adjunct catalyst, both weight-percentages based on the weight of the oil in said zone; and establishing and maintaining the concentraton of said adjunct catalyst in said zone broadly proportional to the soap concentration in said feed oil fed to said zone, said soap concentration being from about 0.01 to about 0.25 weight-percent by weight of said feed oil; said hydrogenation proceeding substantially insensitively to the presence of said contaminant soap in said feed oil.

13. The process of claim 12 wherein said adjunct catalyst is present from about 1 to about 3 weight-percent.

* * * * *